US005945895A

United States Patent [19]

Ono

[11] Patent Number: 5,945,895

[45] Date of Patent: Aug. 31, 1999

[54] RESONANT FREQUENCY COMPENSATED DIELECTRIC FILTER

[75] Inventor: Shoji Ono, Nagoya, Japan

[73] Assignee: NGK Spark Plug Co.,Ltd., Nagoya, Japan

[21] Appl. No.: 08/953,238

[22] Filed: Oct. 17, 1997

[30] Foreign Application Priority Data

Oct. 18, 1996 [JP] Japan ..... 8-297519

[51] Int. Cl.[6] ..... H01P 1/205

[52] U.S. Cl. ..... 333/206; 333/207

[58] Field of Search ..... 333/202, 206, 333/207, 222–224

[56] References Cited

U.S. PATENT DOCUMENTS

| | | | |
|---|---|---|---|
| 4,464,640 | 8/1984 | Nishikawa et al. | 333/203 X |
| 4,745,379 | 5/1988 | West et al. | 333/222 X |
| 4,987,393 | 1/1991 | Yorita et al. | 333/202 |
| 5,525,946 | 6/1996 | Tsujiguchi et al. | 333/206 X |
| 5,528,207 | 6/1996 | Ito | 333/206 |
| 5,642,084 | 6/1997 | Matsumoto et al. | 333/207 X |

FOREIGN PATENT DOCUMENTS

| | | | |
|---|---|---|---|
| 7-245505 | 9/1995 | Japan | 333/206 |
| 9-139607 | 5/1997 | Japan | 333/206 |

*Primary Examiner*—Seungsook Ham
*Attorney, Agent, or Firm*—Larson & Taylor

[57] ABSTRACT

In a dielectric filter comprising a dielectric ceramic block which is provided with three or more than three resonators juxtaposed and a pair of input/output pads formed on the peripheral surface of the dielectric ceramic block, arranged opposite to each other at locations close to a short-circuiting end surface of the dielectric ceramic block and facing the respective outermost resonators and electrically connected to the respective outermost resonators by way of respective connecting conductive paths, the effect of lowering the resonant frequency of the outermost resonators by the input/output pads can be offset by arranging a strip-shaped electrode-free zone extending from the edge of the opening of the central resonator in the direction perpendicular to the longer edges of the short-circuiting end surface.

6 Claims, 5 Drawing Sheets

RESONANT FREQUENCY COMPENSATED DIELECTRIC FILTER

BACKGROUND OF THE INVENTION

1. Field of the Invention

The present invention relates to a dielectric filter comprising a plurality of juxtaposed dielectric resonators arranged in a dielectric ceramic block.

2. Prior Art

There are known dielectric filters of the type comprising a rectangularly parallelepipedic dielectric ceramic block, three or more than three resonators formed by boring so many through holes in the dielectric ceramic block and coating the peripheral walls thereof with an inner conductor and an outer conductor covering the outer peripheral surface of the dielectric ceramic block, except one end surface of the dielectric ceramic block which is intended to function as an open circuit end on which one opening ends of the through holes are arranged.

FIGS. 1 and 2 of the accompanying drawings show a conventional dielectric filter of the above identified type comprising a dielectric ceramic block A provided with three resonators B and C and an outer conductor D, wherein a pair of input/output pads P are formed on the peripheral surface portions of the dielectric ceramic block A, arranged opposite to each other at locations close to the short-circuiting end surface of the dielectric ceramic block A and facing the respective outer resonators C and electrically connected to the respective outer resonators C by way of respective conductive holes E each of said input/output pads P being separated from the outer conductor D by an insulating zone F surrounding it.

While the resonators B and C are normally made to have a length equal to $\lambda/4$ or a quarter of the specified resonant frequency, the above arrangement of input/output pads P disposed vis-a-vis the respective outer resonators C at locations close to the short-circuiting end surface gives rise to a problem that the resonant frequency of the outer resonators C is decreased due to the provision of the input/output pads P separated from the outer conductor D by respective insulating zones F and the partial removal of the outer conductor D and consequently the resonant frequency of the outer resonators C comes to disagree with that of the central resonator B at the cost of filtering performance.

This problem may be dissolved by providing a projection G in a central area of the bottom side surface of the dielectric ceramic block A as shown in FIGS. 1 and 2, which is the short-circuiting end of the dielectric ceramic block A so as to make the resonant length of the outer resonators C shorter than that of the central resonator B and shift the resonant frequency of the resonators C upward in advance in order to compensate the lowered resonant frequency of the outer resonators C caused by the input/output pads P and make the resonant frequencies of all the resonators B and c consequently agree with each other.

It should be appreciated, however, that a conductive film H is formed on the short-circuiting end surface of the conventional dielectric filter and connected to the edges of the openings of the resonators on that side. The conductive film H is typically prepared by screen printing which is adapted to mass production. However, with the configuration of the dielectric filter of FIGS. 1 and 2 having a projection G formed in a central area of the short-circuiting end surface, the screen printing technique cannot feasibly be used and the conductive film H has to be formed by applying a conductive material to that side by means of a brush at the cost of manufacturing efficiency. In short, such a configuration is not adapted to mass production.

It is, therefore, an object of the present invention to provide a dielectric filter that can make the resonant frequencies of the resonators agree with each other and, at the same time, electrically connect the input/output pads and the respective outermost resonators without requiring the formation of a projection on the short-circuiting end surface of a dielectric ceramic block.

SUMMARY OF THE INVENTION

According to one aspect of the present invention, there is provided a dielectric filter comprising a dielectric ceramic block, three or more than three resonators each of which includes a through hole in the dielectric ceramic block and an inner conductor provided on a peripheral wall of the through hole, an outer conductor covering a specific area of an outer peripheral surface of the dielectric ceramic block except one end surface of the dielectric ceramic block which forms an open-circuiting end surface on which one opening ends of the through holes are positioned, and a pair of input/output pads formed on the outer peripheral surface of the dielectric ceramic block, arranged opposite to each other at locations close to the short-circuiting end surface of the dielectric ceramic block and facing the respective outermost resonators and electrically connected to the respective outermost resonators by way of respective conductor paths, wherein the short-circuiting end surface of the dielectric ceramic block is provided with at least one strip-shaped electrode-free zone for decreasing a resonant frequency of the remaining resonator(s) other than the outermost resonators, each strip-shaped electrode-free zone being arranged to be extended from the edge of the opening of each remaining resonator.

Preferably, each strip-shaped electrode-free zone may be arranged to be extended from the edge of the opening of each remaining resonator in the direction perpendicular to the longer edges of the short-circuiting end surface.

Each strip-shaped electrode-free zone may be arranged to be extended from the edge of the opening of each remaining resonator toward one of the longer edges of the short-circuiting end surface.

In the dielectric filter according to one aspect of the present invention, each of the input/output pads may be separated from the outer conductor by an insulating zone surrounding it. Alternatively, one end of each of the input/output pads may be connected to the outer conductor.

With the above arrangement, the resonators are made to have a length slightly smaller than the length corresponding to their proper resonant frequency in order to show a higher initial resonant frequency. Then, the resonant frequency of the remaining resonator(s) other than the outermost resonators is so regulated as to become lower by means of a strip-shaped electrode-free zone in order to offset the effect of the downward shift of the resonant frequency of the outermost resonators caused by the input/output pads that are formed close to the short-circuiting end surface. Thus, all the resonant frequencies of the resonators will consequently be lowered.

If the length of the resonators is so selected as to be smaller than $\lambda/4$ or a quarter of the specified resonant frequency and then their resonant frequencies are regulated to become equal to that value by the downward frequency shift, then a dielectric filter having a proper resonant frequency will be realized.

According to another aspect of the present invention, the open-circuiting end surface of the dielectric ceramic block is provided with at least one additional conductor for increasing a resonant length of the remaining resonator(s) other than the outermost resonators, each additional conductor being arranged to be extended from the edge of the opening of each remaining resonator.

Preferably, each additional conductor may be arranged to be extended from the edge of the opening of each remaining resonator in the direction perpendicular or parallel to the longer edges of the open-circuiting end surface.

Each additional conductor may comprise an extension of the inner conductor of each remaining resonator.

In this filter, also, each of the input/output pads may be separated from the outer conductor by an insulating zone surrounding it. Alternatively, one end of each of the input/output pads may be connected to the outer conductor.

With such an arrangement, the effective resonant length of the remaining resonator(s) other than the outermost resonators will be made longer by the extended additional conductor. Therefore, if the length of the resonators is so selected as to be smaller than $\lambda/4$ or a quarter of the specified resonant frequency and then their resonant frequencies are regulated to become equal to that value by the downward frequency shift, the effect of the downward shift of the resonant frequency of the outermost resonators caused by the input/output pads that are formed close to the short-circuiting end surface will be offset by the downward shift of the frequency of the remaining resonator(s) other than the outermost resonators and a dielectric filter having a proper resonant frequency will be realized.

DETAILED DESCRIPTION OF THE PREFERRED EMBODIMENTS

The present invention will now be described by referring to the accompanying drawings that illustrate preferred embodiments of the present invention. The components that are common to all the embodiments are denoted respectively by the same reference symbols and will not be described duplicatively.

Figure 1:
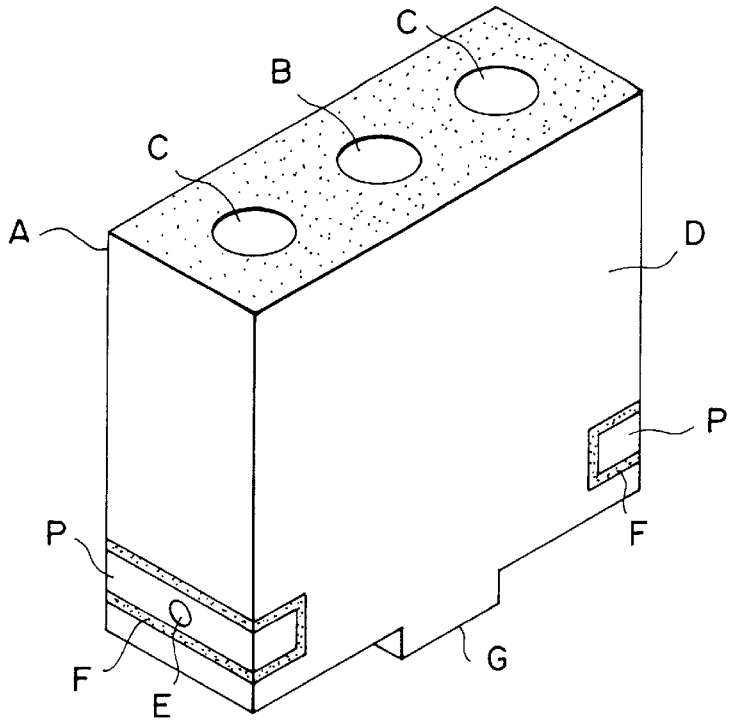
FIG. 1 PRIOR ART
FIG. 1 is a schematic perspective view showing a conventional, dielectric filter of the type under consideration.
Figure 2:
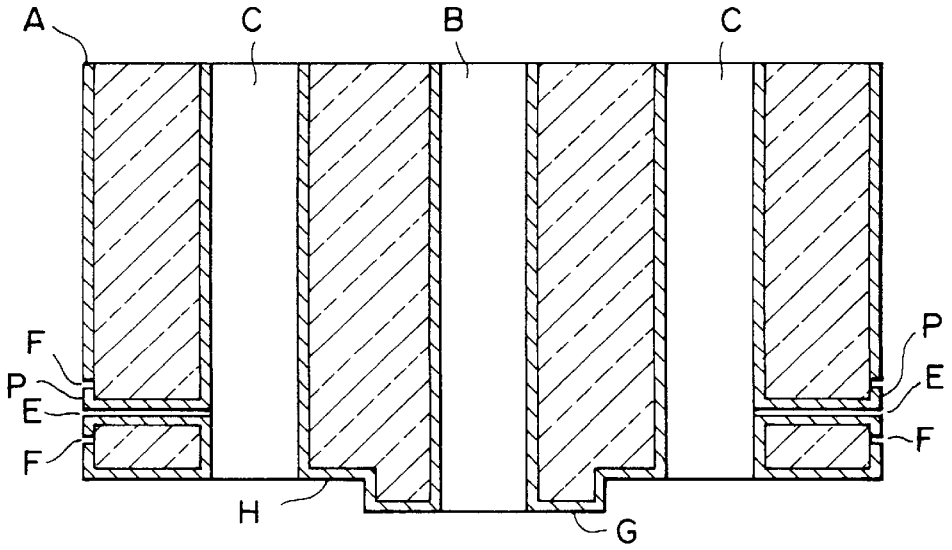
FIG. 2 PRIOR ART
FIG. 2 is a schematic sectional view of the dielectric filter of FIG. 1.
Figure 3:
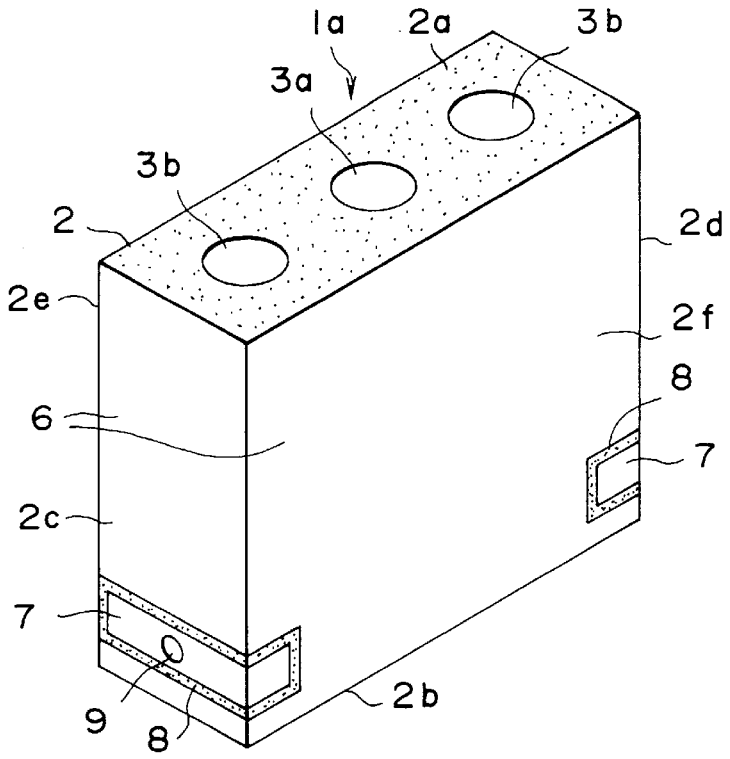
FIG. 3 is a schematic perspective view showing an embodiment of a dielectric filter according to the present invention.
Figure 4:
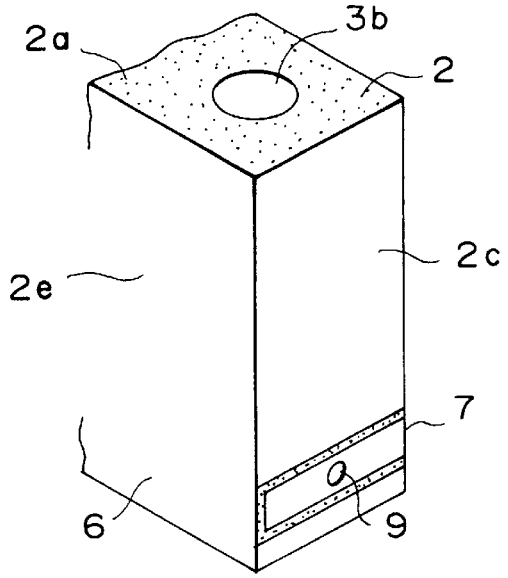
FIG. 4 is a schematic perspective view of the portion of the dielectric filter of FIG. 3 as viewed from the rear side.
Figure 5:
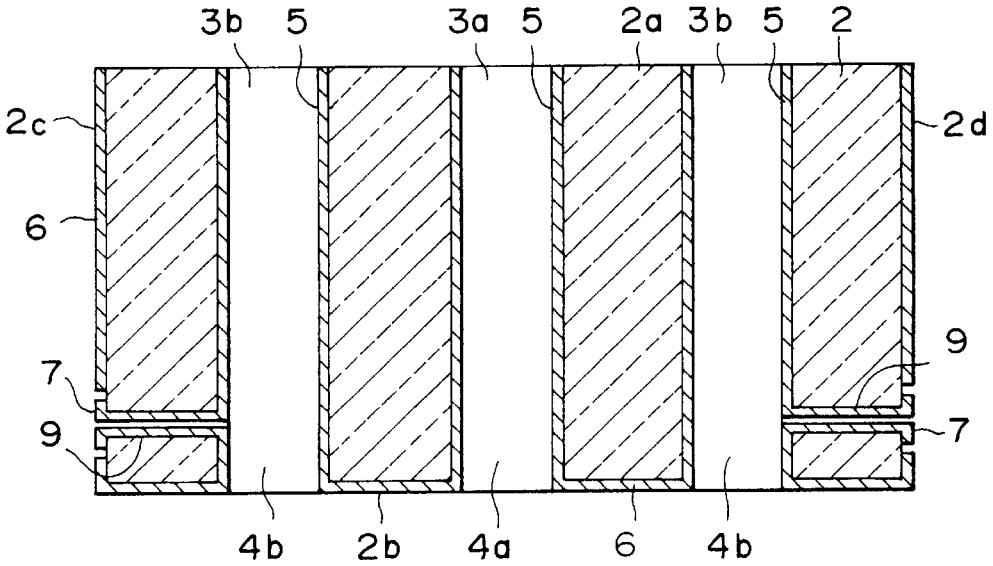
FIG. 5 is a longitudinal section of the dielectric filter shown in FIG. 3.

FIGS. 3 to 5 illustrate a first embodiment of a dielectric filter according to the present invention, which is a three-stage type dielectric filter 1*a* comprising a dielectric ceramic block 2 on which three resonators 3*a* and 3*b* are provided. The dielectric ceramic block 2 of the dielectric filter 1*a* is rectangularly parallelepipedic having six outer surfaces 2*a*, 2*b*, 2*c*, 2*d*, 2*e* and 2*f*, and made of a titanium oxide type ceramic material. The resonators 3*a* and 3*b* are arranged in parallel with each other between the lateral side surfaces 2*c*, and 2*d* of the block 2. They are formed by covering the peripheral walls of through holes 4*a* and 4*b* provided on the dielectric ceramic block 2 with respective inner conductors 5. The outer surfaces 2*b*, 2*c*, 2*d*, 2*e* and 2*f* of the dielectric ceramic block 2 are coated with an outer conductor 6 except the outer surface 2*a* which forms an open circuit end surface on which the corresponding opening ends of the through holes 4*a* and 4*b* are positioned. The outer conductor 6 operates as a shield electrode. Each of the resonators 3*a* and 3*b* has a length slightly smaller than $\lambda/4$ or a quarter of the specified resonant frequency for an intended dielectric filter for the reason as will be described hereinafter.

A pair of input/output pads 7 are formed on the lateral side surfaces 2*c*, 2*d* and 2*f* of the dielectric ceramic block 2, arranged opposite to each other at locations close to the short-circuiting end surface 2*b* of the dielectric ceramic block 2 and facing the respective outer resonators 3*b*. Each of said input/output pads 7 is separated from the outer conductor 6 by an insulating zone 8 surrounding it. The input/output pads 7 are electrically connected to the respective inner conductors 5 provided on the peripheral walls of the through holes 4*b* of the outer resonators 3*b* by way of respective connecting conductor paths 9.

Typically, the input/output pads 7 will be electrically connected to an electric path on a printed circuit board not shown.

Figure 6:
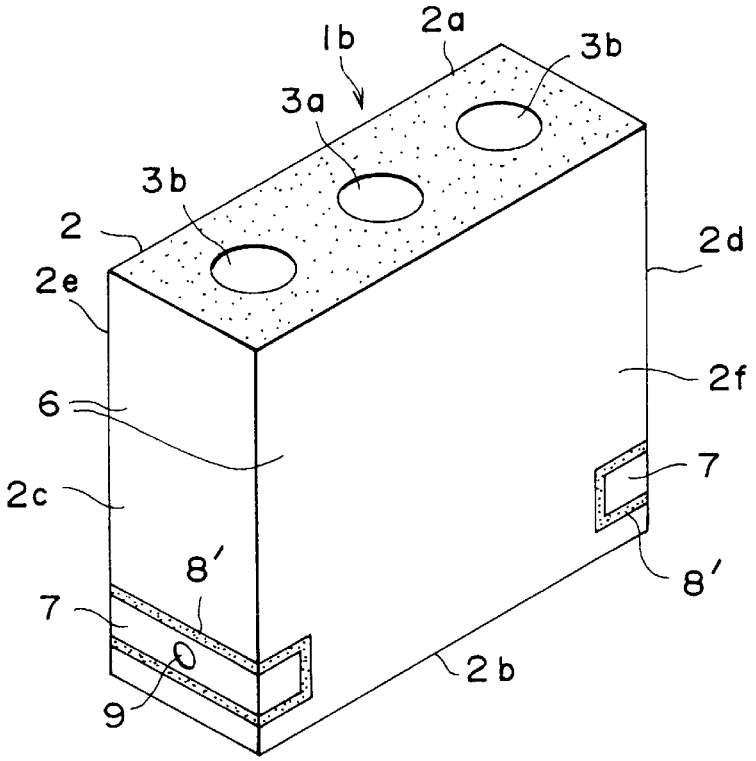
FIG. 6 is a schematic perspective view showing a modification of the dielectric filter shown in FIG. 3.
Figure 7:
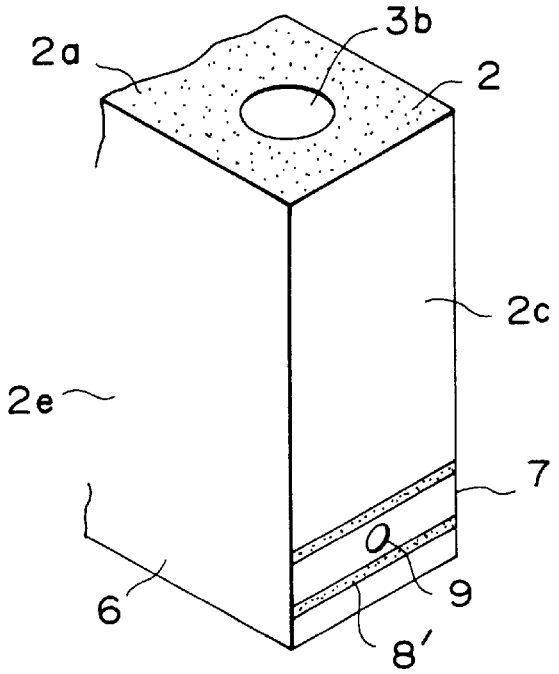
FIG. 7 is a schematic perspective view of the portion of the dielectric filter of FIG. 6 as viewed from the rear side.

FIGS. 6 and 7 illustrate a modification of the embodiment shown in FIGS. 3 to 5. In the illustrated dielectric filter 1*b*, a pair of input/output pads 7 are formed on the opposite lateral side surfaces 2*c*, and 2*d* of the dielectric ceramic block 2, arranged opposite to each other at locations close to the short-circuiting end surface 2*b* of the dielectric ceramic block 2 and facing the respective outer resonators 3*b*. One end of each of the input/output pads 7 is connected to the outer conductor 6 and the other end and both side edges thereof are separated from the outer conductor 6 by an insulating zone 8'.

It should be noted here, however, that the resonant frequency of each of the resonators 3*b* may be decreased by the input/output pads 7 formed on the peripheral surfaces of the dielectric ceramic block 2, arranged opposite to each other at locations close to the short-circuiting end surface 2*b* of the dielectric ceramic block 2 and facing the respective outer resonators 3*b*. Since the conductor lengths defined respectively by the through holes 4*a* and 4*b* of the resonators 3*a* and 3*b* are identical with each other, the provision of the input/output pads 7 makes the resonant frequency of the resonators 3*b* lower than that of the central resonator 3*a*. Consequently, such a dielectric filter does not provide a satisfactory filtering effect.

Then, in the dielectric filters 1*a* and 1*b* according to the above embodiments of the invention, the resonant frequencies of the resonators 3*a* and 3*b* are made to agree with each other in a manner as described below.

Figure 8:
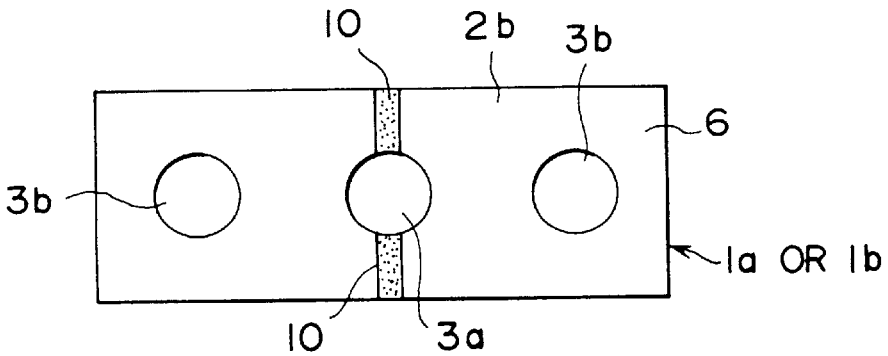
FIG. 8 is a bottom view of the dielectric filter of FIG. 3 or 6.

Referring to FIG. 8, a strip-shaped electrode-free zone 10 is extended from the edge of the opening of the central resonator 3*a* on the short-circuiting end surface 2*b* of the dielectric ceramic block 2 in the direction perpendicular to the longer edges of the short-circuiting end surface 2*b* to cut the outer conductor 6 on the short-circuiting end surface 2*b* into halves. The strip-shaped electrode-free zone 10 has the effect of lowering the resonant frequency of the central resonator 3*a*.

Thus, the effect of lowering the resonant frequency of the outer resonators 3*b* by the input/output pads 7 can be offset by with the above arrangement of a strip-shaped electrode-free zone 10 and the resonant frequencies of the resonators can be made substantially agree with each other.

Note that the length of each of the resonators 3*a* and 3*b* has to be made smaller than the specified value corresponding to the specified resonant frequency in advance so that the specified resonant frequency is achieved by the strip-shaped electrode-free zone 10 for the central resonator 3*a* and by the input/output pads 7 for the outer resonators 3*b* to provide a satisfactory filtering effect.

Figure 9:
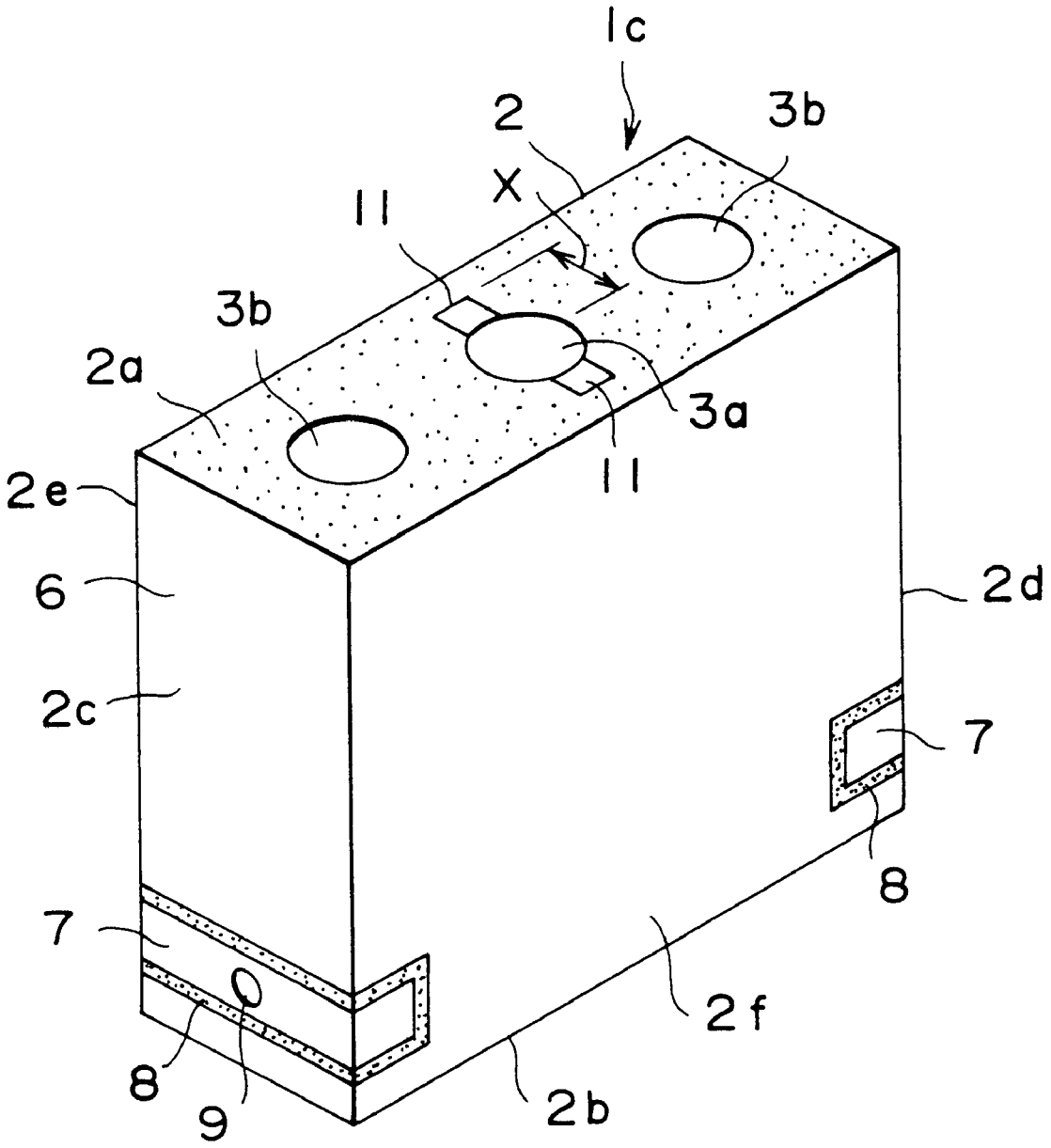
FIG. 9 is a schematic perspective view of another embodiment of a dielectric filter according to the present invention and having an extended conductor.

FIG. 9 illustrates a dielectric filter 1c according to another embodiment of the present invention, in which another arrangement is provided for offsetting the adverse effect of arranging a pair of input/output pads 7.

In this embodiment, the inner conductor 5 of the central resonator 3*a* is extended from the edge of the opening on the open-circuiting end surface 2*a* of the dielectric ceramic block 2 to form an additional or extended conductor 11 in order to increase the effective resonant length of the central resonator 3*a*. The conductor 11 is arranged to be extended in the direction perpendicular to the longer edges of the open-circuiting end surface 2*a*. Alternatively, the conductor 11 may be arranged to be extended in the direction parallel to the longer edges of the open-circuiting end surface 2*a*.

As the conductor 11 is formed as an extension of the central resonator 3*a*, the resonant frequency of the latter is lowered.

In the embodiment illustrated in FIG. 9, one end of each of the input/output pads 7 may be connected to the outer conductor 6 and the other end and both side edges thereof may be separated from the outer conductor 6 by an insulating zone.

With such an arrangement, the effective resonant length of the central resonator 3*a* will be made longer by the extended conductor 11 in advance. Therefore, if the length of the resonators 3*a* and 3*b* is so selected as to be smaller than $\lambda/4$ or a quarter of the specified resonant frequency and then their resonant frequencies are regulated to become equal to that value by the downward frequency shift, the effect of the downward shift of the resonant frequency of the outer resonators 3*b* caused by the input/output pads 7 that are formed close to the short-circuiting end surface 2*b* will be offset by the downward shift of the frequency of the central resonator 3*a*. In this way, there can be provided a dielectric filter substantially having a proper resonant frequency of $\lambda/4$. Then, the resonant frequencies of the resonators 3*a* and 3*b* will be substantially made equal relative to each other.

While the resonators 3*a* and 3*b* of the above embodiments have a circular cross section, they may alternatively have a cross section that is square or of some other geometric form.

Also, it should be appreciated that the present invention is applied not only to the dielectric filter having three resonators 3*a* and 3*b* as illustrated in the embodiments but also to any filter arrangement having more than three resonators.

Furthermore, the embodiments illustrated in FIGS. 3 to 7 may be modified in such a manner that a strip-shaped electrode-free zone 10 is extended from the edge of the opening of the central resonator 3*a* on the short-circuiting end surface 2*b* of the dielectric ceramic block 2 toward only one of the longer edges of the short-circuiting end surface 2*b*.

With the embodiment illustrated in FIG. 8 the additional or extended conductor 11 may be provided so that it extends from the edge of the opening on the open-circuiting end surface 2*a* of the dielectric ceramic block 2 toward only one of the longer edges of the open-circuiting end surface 2*a*. Also, the additional or extended conductor 11 may be arranged to have a width substantially equal to or larger than the diameter of the respective through hole 4*a*.

As described above, in any of the embodiments of dielectric filter according to the present invention, comprising a pair of input/output pads arranged on lateral side surfaces of the dielectric ceramic block at respective locations close to the short-circuiting end surface of the dielectric ceramic block, the effect of lowering the resonant frequency of the outer resonators due to the input/output pads can be offset by lowering the resonant frequency of the central resonator by means of the provision of an strip-shaped electrode-free zone extending from the edge of the opening of the central resonator on the short-circuiting end surface or by forming an extended conductor also extending from the edge of the opening of the central conductor on the open-circuiting end surface. Then, the resonant frequencies of the resonators will be substantially made equal relative to each other to realize a dielectric filter substantially having a proper resonant frequency, while the outer resonators are electrically coupled with the respective input/output pads.

I claim:

1. A dielectric filter comprising a dielectric ceramic block, at least three resonators each having same length, each of said resonators including a through hole provided in the dielectric ceramic block and having first and second opening ends, and an inner conductor provided on a peripheral wall of the through hole, an outer conductor covering a specific area of an outer peripheral surface of the dielectric ceramic block except for one end surface of the dielectric ceramic block which forms an open-circuiting end surface on which the first opening ends of each of the through holes are positioned, the second opening ends of each of the through holes being positioned on a short-circuiting end surface which is disposed oppositely to the open-circuiting end surface, and a pair of input/output pads formed on the outer peripheral surface of the dielectric ceramic block, arranged opposite to each other at locations close to the short-circuiting end surface of the dielectric ceramic block and facing the respective outermost resonators and electrically connected to the respective outermost resonators by way of respective connecting conductor paths, each of said input/output pads being separated from the outer conductor by an insulating zone surrounding the outer conductor, the short-circuiting end surface of the dielectric ceramic block being provided with at least one strip-shaped electrode-free zone for decreasing the resonant frequency of the remaining resonators other than the outermost resonators, a said strip-shaped electrode-free zone being respectively associated with each one of all remaining resonators and each said strip-shaped electrode-free zone extending from the edge of the opening of each remaining resonator in a direction perpendicular to the longer edges of the short-circuiting end surface.

2. A dielectric filter as claimed in claim 1, wherein the number of the resonators is three, and wherein two strip-shaped electrode-free zones are arranged across the opening of the central resonator on the short-circuiting end surface so that the short-circuiting end surface is divided into halves.

3. A dielectric filter as claimed in claim 1, wherein said each strip-shaped electrode-free zone extends from the edge of the opening of the associated remaining resonator toward one of the longer edges of the short-circuiting end surface.

4. A dielectric filter comprising a dielectric ceramic block, at last three resonators each having same length, each of said resonators including a through hole provided in the dielectric ceramic block and having first and second opening ends, and an inner conductor provided on a peripheral wall of the through hole, an outer conductor covering a specific area of an outer peripheral surface of the dielectric ceramic block except for one end surface of the dielectric ceramic block which forms an open-circuiting end surface on which the first opening ends of each of the through holes are positioned, the second opening ends of each of the through holes being positioned on a short-circuiting end surface which is disposed oppositely to the open-circuiting end surface, and a pair of input/output pads formed on the outer peripheral-surface of the dielectric ceramic block, arranged opposite to each other at locations close to the short-circuiting end surface of the dielectric ceramic block and facing the respective outermost resonators and electrically connected to the respective outermost resonators by way of respective connecting conductor paths, one end of each of said input/output pads being connected to the outer conductor, the short-circuiting end surface of the dielectric ceramic block being provided with at least one strip-shaped electrode-free zone for decreasing the resonant frequency of the at least one remaining resonator other than the outermost resonators, a said strip-shaped electrode-free zone being respectively associated with each one of all remaining resonators and each said strip-shaped electrode-free zone extending from the edge of the opening of the associated remaining resonator in a direction perpendicular to the longer edges of the short-circuiting end surface.

5. A dielectric filter as claimed in claim 4, wherein the number of the resonators is three, and wherein two strip-shaped electrode-free zones are arranged across the opening of a central resonator on the short-circuiting end surface of the dielectric ceramic block so that the short-circuiting end surface is divided into halves.

6. A dielectric filter as claimed in claim 4, wherein said each strip-shaped electrode-free zone extends from the edge of the opening of the associated remaining resonator toward one of the longer edges of the short-circuiting end surface.

* * * * *